US011712907B1

(12) United States Patent
Matten

(10) Patent No.: US 11,712,907 B1
(45) Date of Patent: Aug. 1, 2023

(54) PLATEN WITH HINGED SIDE WALLS FOR IMPROVED HOOPING

(71) Applicant: CreateMe Technologies LLC, New York, NY (US)

(72) Inventor: David Bennet Matten, Mountain View, CA (US)

( * ) Notice: Subject to any disclaimer, the term of this patent is extended or adjusted under 35 U.S.C. 154(b) by 0 days.

(21) Appl. No.: 17/710,878

(22) Filed: Mar. 31, 2022

(51) Int. Cl.

| | |
|---|---|
| ***B41J 11/02*** | (2006.01) |
| ***D05C 1/02*** | (2006.01) |
| ***D06C 3/08*** | (2006.01) |
| ***B41F 17/00*** | (2006.01) |
| ***B41J 3/407*** | (2006.01) |
| ***B44D 3/18*** | (2006.01) |

(52) U.S. Cl.
CPC ..... *B41J 11/02* (2013.01); *B41F 17/005* (2013.01); *B41J 3/4078* (2013.01); *B44D 3/185* (2013.01); *D05C 1/02* (2013.01); *D06C 3/08* (2013.01)

(58) Field of Classification Search
CPC . B41J 11/02; B41J 3/4078; B41J 13/10; B41J 13/22; B41F 17/005; B44D 3/18; B44D 3/185; D05C 1/02; D06C 3/08; D06C 9/04
See application file for complete search history.

(56) References Cited

U.S. PATENT DOCUMENTS

| | | | | |
|---|---|---|---|---|
| 3,271,040 | A * | 9/1966 | Spademan | A63C 9/086 280/624 |
| 3,273,497 | A * | 9/1966 | Thomas | B41F 15/36 101/415.1 |
| 3,886,990 | A * | 6/1975 | Campione | B44D 3/185 160/374.1 |
| 4,027,413 | A * | 6/1977 | Moede | B44D 3/185 40/792 |
| 9,073,369 | B2 * | 7/2015 | Yanagishita | B41J 15/16 |
| 9,272,538 | B2 * | 3/2016 | Livingston | B41J 3/4078 |
| 11,198,963 | B1 * | 12/2021 | Thammasouk | D05C 1/04 |
| 2003/0136073 | A1 * | 7/2003 | Arx | E04B 9/303 52/656.1 |
| 2009/0217557 | A1 * | 9/2009 | Serrano | B44D 3/185 38/102.4 |
| 2018/0170087 | A1 * | 6/2018 | Kobayashi | B41M 7/009 |

FOREIGN PATENT DOCUMENTS

| | | | | |
|---|---|---|---|---|
| EP | 2775022 | A1 * | 9/2014 | D05B 11/00 |
| JP | 2005334250 | A * | 12/2005 | B41F 15/22 |
| WO | WO-2017021960 | A1 * | 2/2017 | B41F 15/22 |

* cited by examiner

*Primary Examiner* — Ismael Izaguirre

(57) ABSTRACT

A platen and hoop configured to securely hold a garment in place on a platen. The platen and hoop can be used for automated printing of graphics, such as by direct to garment printing (DTG). The hoop has downward extending hoop sidewalls that can surround the platen structure when the hoop is fitted onto the platen. The platen has platen sidewalls that are hinged to a base of the platen, and which rotate upward to hold a fabric workpiece against the hoop sidewalls to securely hold the fabric workpiece during printing. The platen sidewalls can be formed with inward protruding tabs or feet located at their base, and which cause the platen sidewalls to rotate upward when engaged by the hoop sidewalls.

13 Claims, 8 Drawing Sheets

PLATEN WITH HINGED SIDE WALLS FOR IMPROVED HOOPING

FIELD OF THE INVENTION

The present invention relates to a platen for facilitating automated garment handling and manufacture and more particularly to a platen having hinged side walls for securing a fabric during printing such as direct to garment (DTG) printing.

BACKGROUND

The manufacture of garments and textile products has existed for thousands of years. Within recent history many advances have been made with regard to the fabrication of textile products such as with regard to the automated fabrication of textiles themselves. In addition, new types of textile materials such as synthetic materials, synthetic/natural blends and new automated weaving technologies have been developed. The apparel manufacturing, retailing and fitting industries include a diverse range of parties, such as designers, fabric manufacturers, apparel cutting and sewing workers, retailers, tailors, etc. The apparel manufacturing industry relies upon various resources, processes, and equipment to produce finished garments, accessories, footwear, etc. Generally, a process to manufacture a garment includes garment design, fabric production and/or printing, and panel cutting and sewing. Many aspects of apparel manufacturing processes are relatively time consuming and require the coordination of many different geographically dislocated suppliers, vendors, manufacturers and retailers.

In spite of advances in manufacturing technology in the textile and garment industry, the vast majority of the work of fabricating garments has involved large amounts of tedious human labor. Although garments are cut and sewn with the assistance of machines, the process is nevertheless labor-intensive and includes the manual movement of patterns, sewn garments, and operation of sewing machines and other kinds of equipment. For this reason, much of the fabrication of garments has been limited to regions with access to inexpensive labor.

Part of the reason for this lack of automation and labor intensiveness results from the unique attributes of textiles and garments in general. Garments and textile products in general have unique properties that make them difficult to fabric in an automated fashion. For example, fabrics by nature have a soft, flexible, amorphous, and often stretchy nature that makes them difficult to manipulate in a predictable, reliable manner in an automated system.

One recent advance in garment manufacturing has been the development of direct to garment (DTG) printing. Such printing has provided increased versatility and time savings over prior printing methods such as silk-screen printing. Direct to garment (DTG) printing allows graphics to be printed directly to a garment from a digital file such as from a computer or other device. However, most DTG printing systems require human manual manipulation of the garment to be printed to, and as such have not been practically employed in an automated garment manufacturing system. For example, a human operator must manipulate the garment to place it and secure it in a smooth flat manner on a platen, requiring skill and time of the operator.

SUMMARY

The disclosed embodiments provide a device for holding fabric during a manufacturing process. The device includes a platen structure and a hoop structure. The platen structure has a platen base and a plurality of sidewalls hinged to the platen base each of the sidewalls having a foot structure and a platen top supported above the platen base. The hoop structure has an open top and an open bottom and has a plurality of sidewalls. The hoop structure is configured to fit around the platen top when lowered down over the platen structure, and each of the plurality of sidewalls is configured to engage a foot of one of the platen sidewalls.

The device can be configured such that engagement of the hoop sidewall with the foot of a platen sidewall causes the platen sidewall to rotate toward the hoop sidewall. Each foot of the platen sidewall can be configured as a flange that can be oriented at 90 degrees or substantially 90 degrees relative to the rest of the platen sidewall. Each platen sidewall can be connected to the platen base by one or more hinges.

The platen top can be supported above the platen base by a pedestal structure or could be supported by some other means such as one or more column structures. In one embodiment, the hoop structure can have an upper rim and can have one or more attachment brackets connected with the upper rim. In one embodiment, the platen structure can be configured to fit within a garment printer such as a direct to garment (DTG) printer. In another embodiment, the platen structure and hoop structure can be configured to fit within a printer such as a DTG printer when the hoop is engaged on the platen structure.

In one embodiment, the platen sidewalls can be configured to extend outward from the platen top in a resting position and to rotate inward when engaged with the hoop sidewall. In another embodiment, each of the platen sidewalls is configured to hold a portion of a workpiece fabric against a hoop sidewall when a foot of the platen sidewall is engaged by a bottom of the hoop sidewall.

The embodiments can also provide a printer for printing graphics to a garment. The printer can include a printer housing, a platen structure and a hoop structure. The hoop structure is configured to fit over the platen structure and hold a garment workpiece thereon. The hoop structure has downward extending hoop sidewalls. The platen structure and hoop structure are configured to fit at least partially within the printer housing when the hoop is fitted over the platen structure. The platen structure has a plurality of moveable platen sidewalls that are configured to hold a workpiece fabric against the hoop sidewalls when the hoop is engaged on the platen structure.

The printer can include at least one hinge connecting a bottom of each platen sidewall to a base of the platen structure. The bottom of each platen sidewall can have an inward extending tab and can be configured such that engagement of the hoop sidewall with the tab causes the platen sidewall to rotate upward to hold the fabric workpiece against the hoop sidewall.

These and other features and advantages will be apparent to one of skill in the art upon reading the following detailed description of the embodiments in conjunction with the figures. In the figures, like reference numerals used in more than one figure indicate a like element and may be considered in light of the description of the like element presented in any of the other figures having the like elements.

BRIEF DESCRIPTION OF THE DRAWINGS

For a fuller understanding of the nature and advantages of this invention, as well as the preferred mode of use, reference should be made to the following detailed description read in conjunction with the accompanying drawings. The drawings are not presented to scale unless specified otherwise on an individual basis.

DETAILED DESCRIPTION

The following description includes the best embodiments presently contemplated for carrying out the invention. This description is made for the purpose of illustrating the general principles of this invention and is not meant to limit the inventive concepts claimed herein in any way.

Figure 1:
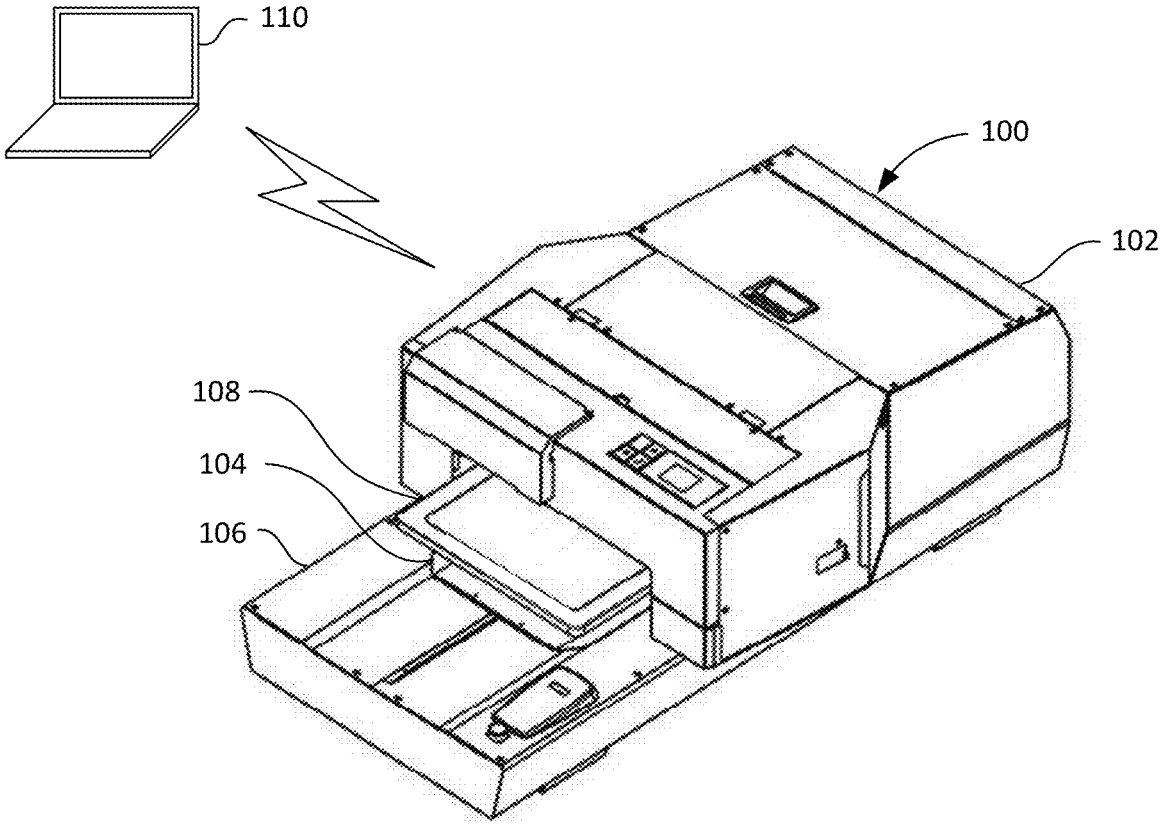
FIG. 1 shows a perspective view of a printer for printing to a fabric such as a garment.

FIG. 1 is a perspective view of a printer 100 for printing graphics onto a garment or other such item. In one embodiment, the printer 100 can be a direct to garment printer, but could also be some other type of printer suitable for printing graphics onto a workpiece constructed of a flexible material such as fabric, vinal, leather, etc.

The printer 100 can include a housing 102 and a platen 104, which can be attached or connected with a base 106. The printer 100 shown herein is just for illustration purposes and the platen 104 is not limited in any way to the physical and functional features of the printer 102. For example, in some embodiments, the printer 100 may not include a housing 102, or may include a housing 102 that only houses the printer nozzle head. In some embodiments, the printer 100 may be designed to allow a robot arm or a Line Guided Vehicle (LGV) robot to position the platen 104 in a position to allow the printer head for printer 100 to print on a garment. A hoop 108, which will be described in greater detail herein below can be configured to fit on or over the platen 104 to secure a garment to the platen during printing. In one embodiment, the printer 100 can be in wired or wireless communication with a computer 110 or other input device to provide information regarding graphics information to be printed to the garment or other flexible item.

Figure 2:
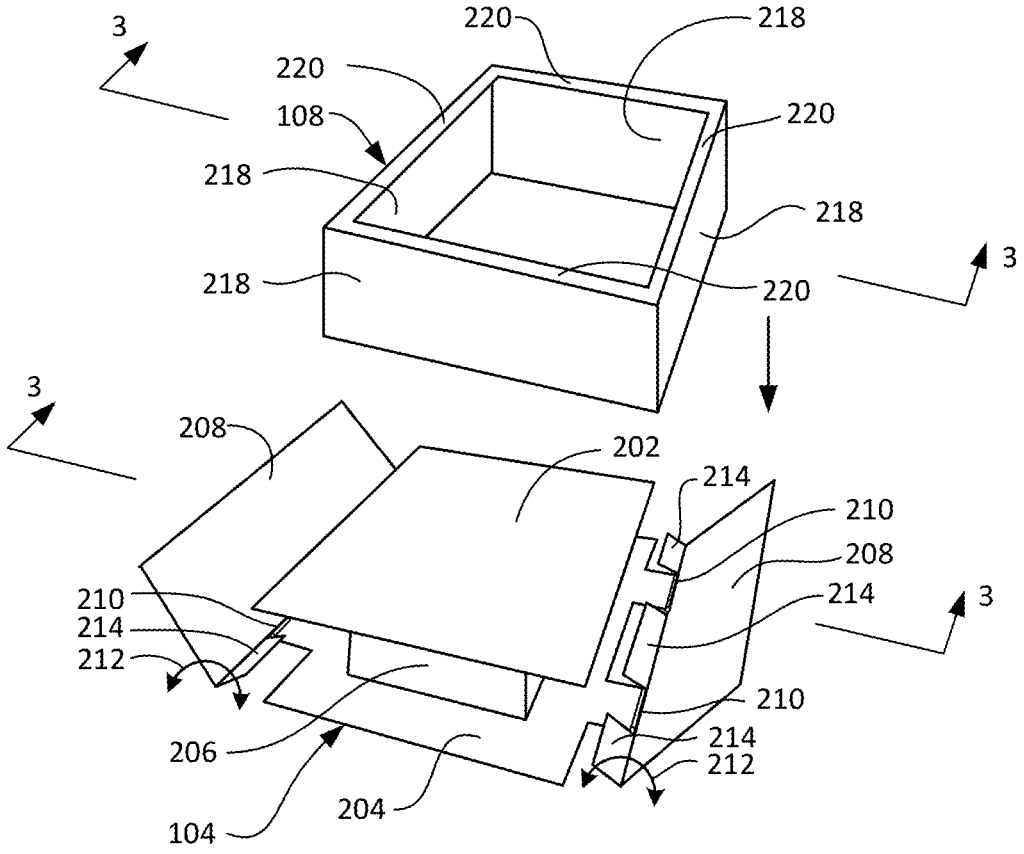
FIG. 2 is a perspective view of a platen having hinged sidewalls and a hoop for securing a garment on the platen during printing.

FIG. 2 shows a perspective view of a platen 104 and a hoop 108. The platen 104 includes a platen top 202, and a platen base 204. The platen can also include a pedestal structure 206 configured to support the platen top 202 above the platen base 204. Although the pedestal 206 is shown in FIG. 2 as being a rectangular structure, this is by way of example only. The pedestal could be any structure that can be functional to support the platen top 202 above the platen base 204, such as, but not limited to one or more support columns. In some embodiments, the platen 103 may include a circular, oval, triangular, star or any other suitable shape.

With continued reference to FIG. 2, the platen structure 104 includes side walls 208, preferably located at opposite sides of the platen structure 104. The side walls 208 are connected with the platen base 204 by one or more hinges 210. The hinges 210 allow the sidewalls to rotate relative to the rest of the platen structure as indicated by arrows 212, as will be described in greater detail herein below. The sidewalls 208 can also be configured with one or more feet portions 214. The feet portions are formed as one or more flanges or tabs, formed near at the bottom of the sidewalls 208 at or near the location of the hinges 210. The feet 214 can be formed as flanges that extend inward at an angle of 90 degrees or nearly 90 degrees relative to the rest of the sidewall 208.

Although FIG. 2 shows only two hinged sidewalls 208 located at opposite sides of the platen structure, the platen structure 104 could include more such side walls such as three or four sidewalls as desired, which could be located into and/or out of the plane of the page in FIG. 2. In FIG. 2, only two such sidewalls 208 are shown for purposes of clarity in order to better illustrate the other structures and features of the platen structure 104.

With continued reference to FIG. 2, the previously described hoop 108 is shown suspended above the platen structure 104. The hoop can have a rectangular prism shape configured to fit around the platen top 202 when lowered down over the platen structure as indicated by arrows 216, as will be described in greater detail herein below. The hoop includes sidewalls 218 and an upper, inward extending lip 220. In some embodiments, the sidewalls 218 may constructed to have an increased coefficient of friction. For example, the sidewalls may be made of or be partially or fully covered by materials such as a polymer such asrubber, felt fabric, or a hook and loop material such as Velcro™ that exerts frictional forces on any garment portion that overhangs from the sides of the platen. In alternative embodiments, any frictional force may be exerted because of a tight fit between the platen structure 104 and the hoop, especially when the fabric of a garment is located in between the two parts of the platen structure. As the hoop 108 is placed onto the platen structure 104, the hoop sidewalls 218 may engage the garment and cause the garment to be pulled into a taut state, eliminating any wrinkles on the top surface of the garment placed on the platen top 202, and affixing the garment in the taut condition and ready for printing. The hoop 108 preferably includes four sidewalls 218, but could include another number of sidewalls 218, such as two or three depending upon design requirements, such as needed clearance demands to accommodate clearance of other structures. The hoop 108 has an open bottom to allow it to be lowered down over the platen top 202, and has an opening at its top, defined by the inner edge of the lip 220 to allow for printing on a fabric or garment by the printer 100 (FIG. 1). In alternative embodiments, the print opening defined by the lip 220 may be shaped as a square, a circle, an oval, a star, etc.

Figure 3:
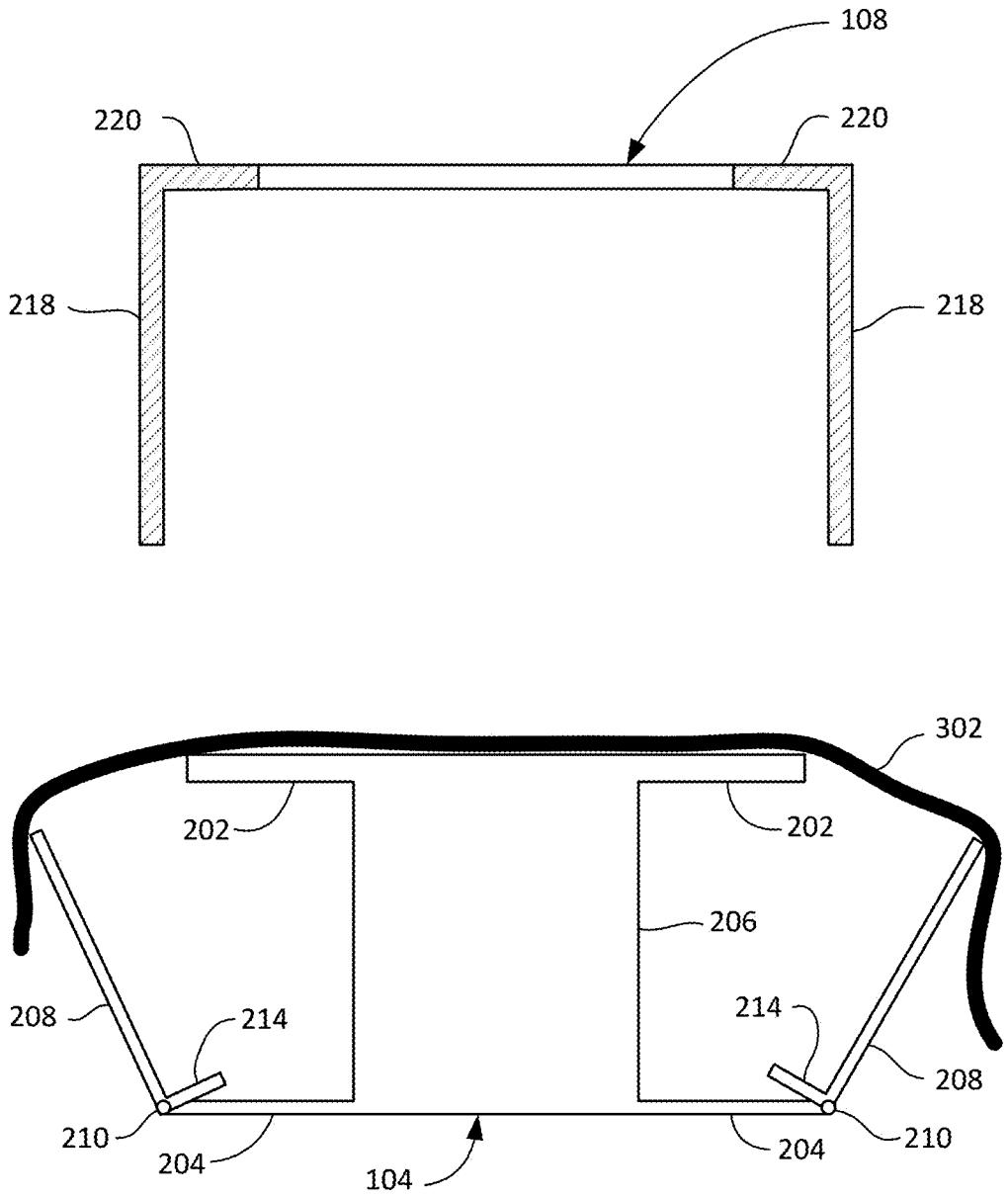
FIG. 3 is a side, cross-sectional view of a platen having a garment placed thereon and a hoop prior to engagement with the platen and garment.

FIG. 3 shows a side, cross sectional view as seen from lines 3-3 of FIG. 2. As shown in FIG. 3, the sidewalls 208 extend outward in a resting position. This can be as a result of passive actuation such as a spring-loaded tension between the side walls 208 and platen base 204 or could be merely as a result of the force of gravity. In alternative embodiments, the sidewalls 208 may be actuated by an active actuator such as an electric motor, electric or pneumatic pistons, other types of actuators. With the sidewalls 302 extended outward, a garment or other flexible workpiece 302 can be easily placed over the platen top 202 in such a manner that the garment 302 can drape over the outward extended sidewalls 208 as shown in FIG. 3. While the workpiece 302 is described as a garment, it should be understood that the workpiece could many different items such as towels, blankets, fashion accessories, etc. The workpiece 302 could be constructed of fabric, but could also be constructed of any number of other materials, such as, but not limited to upholstery, leather, vinal, etc.

Figure 4:
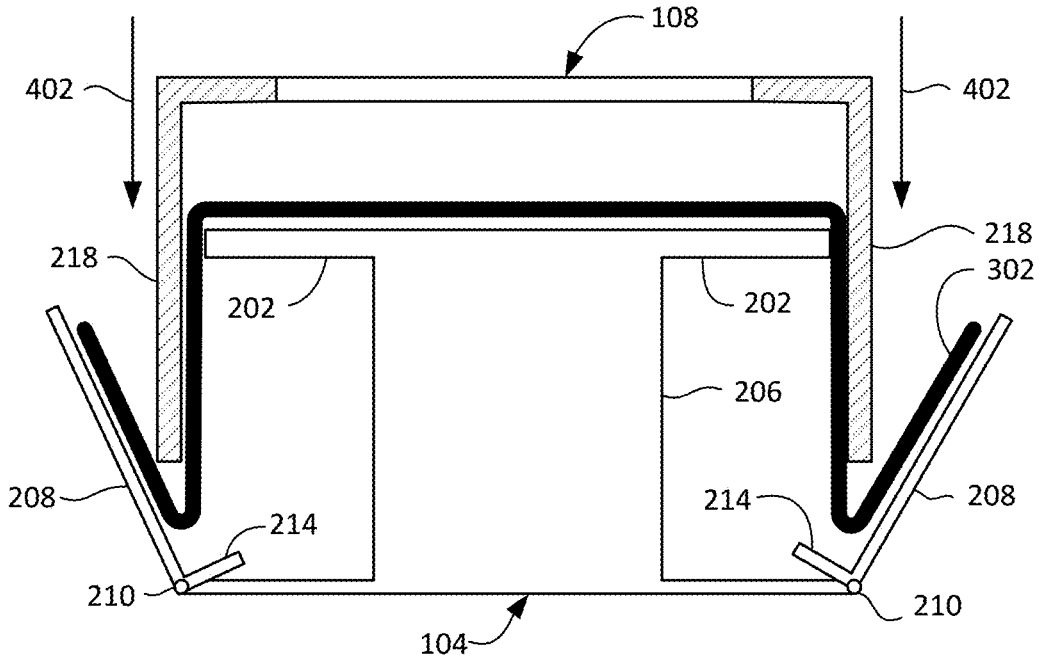
FIG. 4 is a side cross-sectional view of the hoop initiating engagement with the platen and garment.

As shown in FIG. 3, the hoop 108 is located above the platen top 202, with the open bottom end facing the platen top. With reference now to FIG. 4, the hoop 108 is lowered downward over the platen 104 as indicated by arrows 402. The sidewalls 218 of the hoop push the garment 302 down into the space inside of the open platen sidewalls 302. This process also spreads the garment 302 flat over the top of the platen top 202. In some embodiments, the sidewalls 218 may be made of or be partially or fully covered by materials such as rubber, felt fabric, Velcro™ that exerts frictional forces on any garment portion that overhangs from the sides of the platen. In alternative embodiments, any frictional force may be exerted because of a tight fit between the platen structure 104 and the hoop, especially when the fabric of a garment 302 is located in between the two parts of the platen structure. As the hoop 108 is placed onto the platen structure 104, the hoop sidewalls 218 may engage the garment 302 and cause the garment 302 to be pulled into a taut state, eliminating any wrinkles on the top surface of the garment 302 placed on the platen top 202, and affixing the garment 302 in the taut condition and ready for printing.

Figure 5:
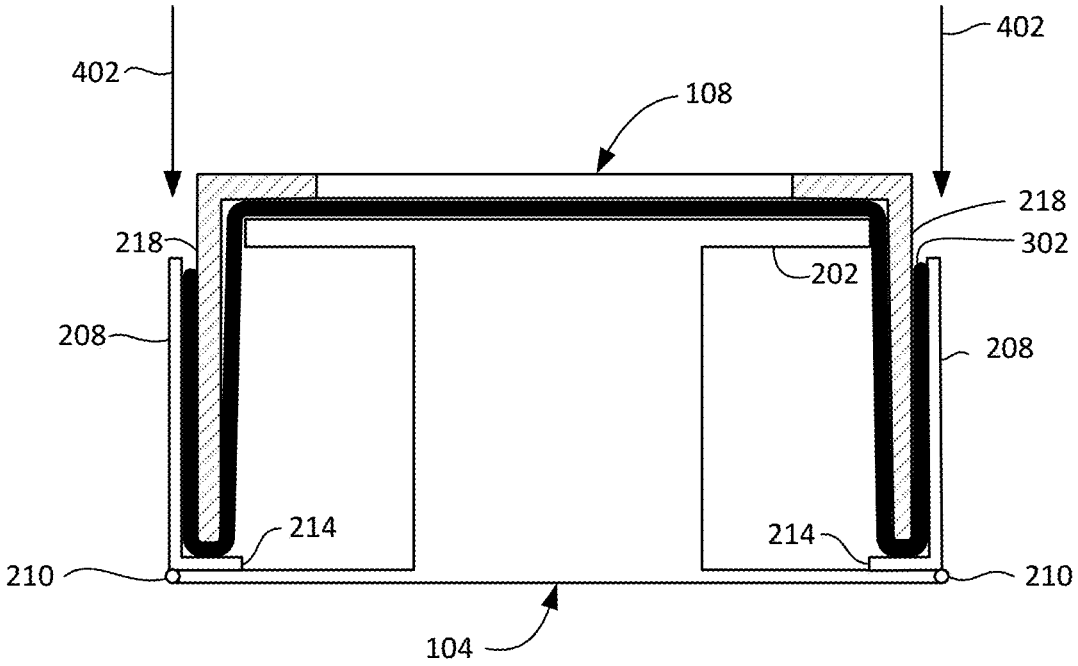
FIG. 5 is a side, cross-sectional view of the hoop engaged with the platen and garment with hinged sidewalls engaging sides of the platen and garment.

With reference now to FIG. 5, the hoop 108 is moved further downward as indicated by arrows 402. The hoop 108 is moved downward until the bottom of the hoop sidewall 218 engages the foot 214, pushing the foot 214 downward and forcing the sidewall 208 upward. This causes the platen sidewall to press against the fabric 302 and hoop sidewall securely holding the garment 302 in place, wherein an outer portion of the garment 302 is pinched between the platen sidewall 208 and the hoop sidewall 218. As a result, the garment 320 is held secure and flat across the top of the platen top 202. It should be pointed out that, since the garment 302 is securely held between the platen sidewall 208 and hoop sidewall 218, the inner extending lip portion 214 of the hoop 108 (FIG. 3) is optional and may not be needed to securely hold the garment 302 during printing. With the garment 302 securely held over the platen 104, the platen 104 and hoop 108 can be moved or held within the printer 100 (FIG. 1) so that printing can be performed on the garment 302. In an alternative embodiment, the excess portion of garment 302 may be hanging from the sides of the platen structure 204 and the hoop sidewalls 218 fully or partially covered in a material that exerts frictional force on the garment will pull the garment 308 into a taut position with the portions of the garment 308 that are hanging on the sides are bunched in between the hoop sidewalls 218 and the pedestal 206.

The above-described platen 104 and hoop greatly facilitates garment placement in an automated system such as a robotic garment manufacturing environment. With reference to FIG. 3, it can be seen that the garment 302 can be merely placed on and draped over the platen top 202 and draped over the outward extended side walls 208. This requires little to no manipulation and no attachment or securing of the garment by an human operator. Therefore, this simple process can be easily performed by an unskilled robot or other mechanical device.

Then, as described above with reference to FIGS. 4-5, the movement of the frame 108 down onto the platen 104 automatically smooths and secures the garment 302 sot that it is smooth and flat on the platen top 202 and securely held in place. Again, no human manual manipulation of the garment is needed, and this process can be performed in an automated environment using mechanical mechanisms.

Figure 6:
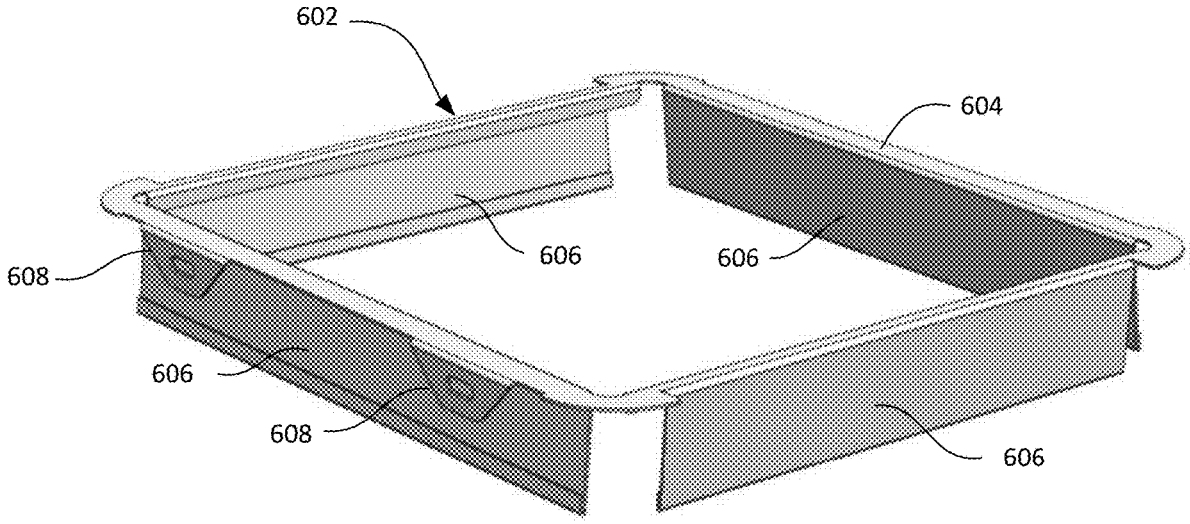
FIG. 6 is a perspective view of a hoop according to an embodiment.

FIG. 6 shows perspective view of a hoop 602 according to an exemplary embodiment. The hoop 602 is an example of a hoop such as the previously described hoop 108 that can be used with the previously described platen 104 to hold a garment or other workpiece during for printing. The hoop 602 has an upper rim 604 and downward extending sidewalls 606. Attachment brackets 608 can be formed on or connected with the upper rim 602. The attachment brackets 608 can be used to connect the hoop 602 with automated tooling or mechanisms to control movement of the hoop 602 relative to a platen 104 as described above with reference to FIGS. 3-5. As can be seen in FIG. 6, the upper rim 604 can extend outward from the sidewalls 606 so as to provide clearance between the attachment brackets 608 (and associated attached mechanism) and the platen sidewalls 208 (FIG. 6 during operation).

The above described embodiments including the novel platen 104 and hoop 108 greatly facilitate the use direct to garment printing in an automate environment. However, the use of the novel platen and hoop design 104, 108 as described above is not merely limited to direct to garment printing. Many other uses and environment exist wherein the novel platen and hoop design can be employed during an automated garment manufacturing or personalization process. For example, the platen 104 and hoop 108 can be used to secure a garment or other flexible item for other printing processes such as silk-screen printing. The above-described embodiments can also be used to hold a garment for performing an embroidery process. In this case, the platen top 202 (FIG. 2 would be fitted with an opening for allowing a needle to pass therethrough, and the pedestal 206 would be configured to receive a bobbin arm within it. In addition, various other processes could utilize the above-described embodiments, such as, sewing, gluing, cutting, etc.

Figure 7:
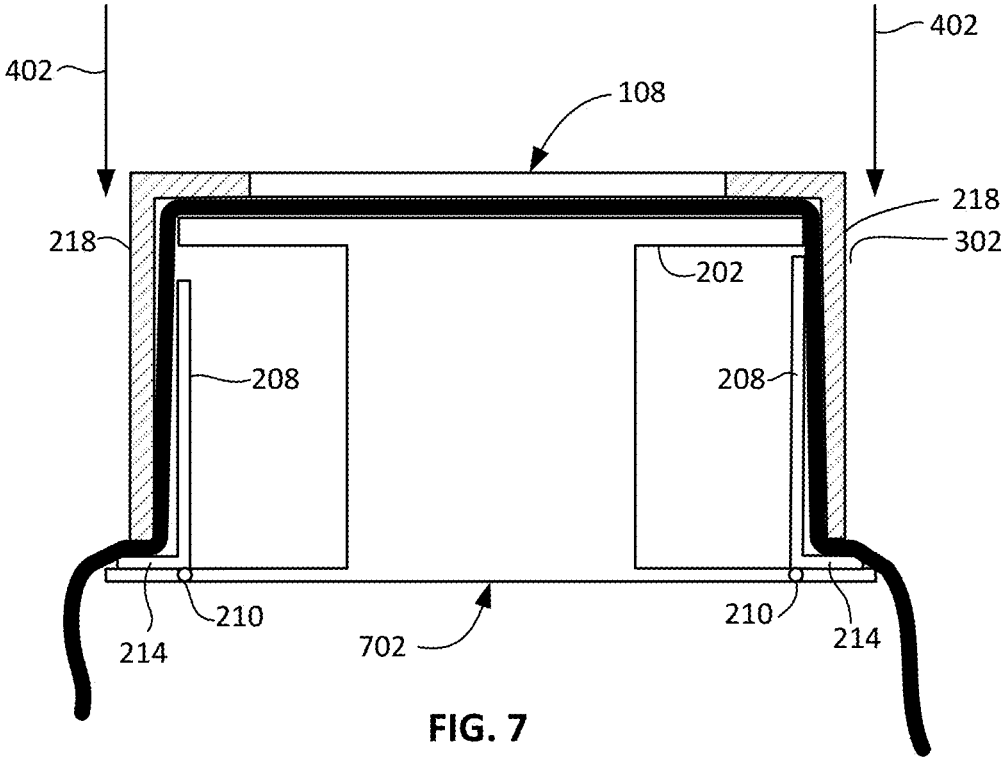
FIG. 7 is a side, cross-sectional view of a hoop and platen according to an alternate embodiment.

FIG. 7 shows a side, cross-sectional view of a hoop 108 and platen 702 according to an alternate embodiment. The platen 702 can have moveable platen sidewalls 208 that are located inside of the hoop sidewalls 218. In a resting state, the platen sidewalls 208 can rotate inward, allowing a garment 302 to drape over the sidewalls 208. When, the hoop 108 is lowered downward, the hoop sidewalls 218 engage the foot of the platen sidewalls, causing the platen sidewalls to rotate upward and outward to hole the garment between the hoop sidewalls 218 and platen sidewalls 208 as shown.

Figure 8:
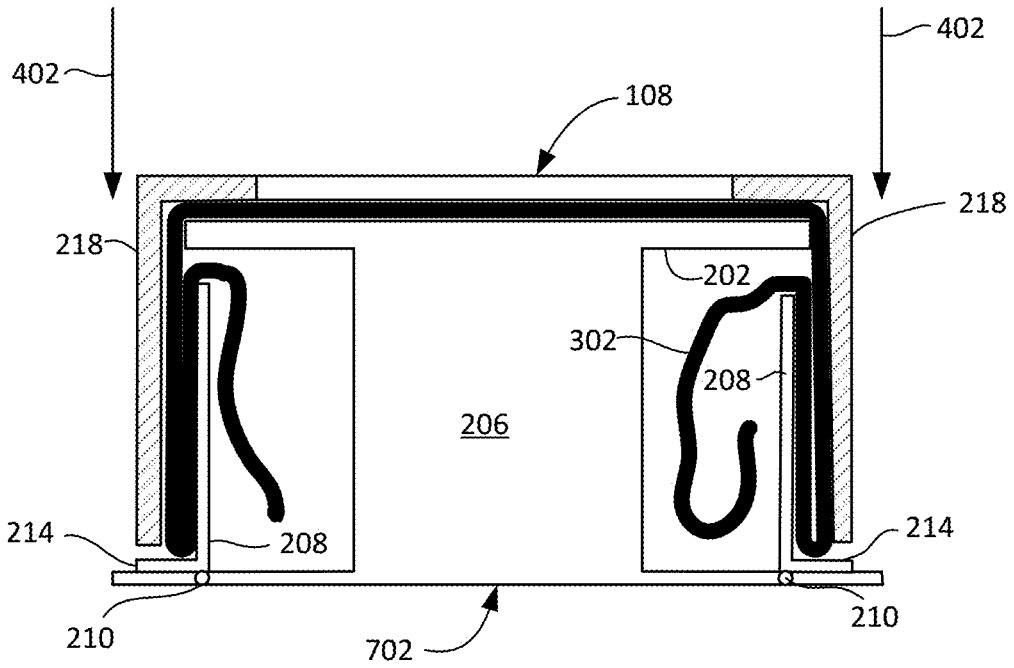
FIG. 8 is a side, cross-sectional view of a hoop and platen according to yet another embodiment.

With reference now to FIG. 8, it can be seen that the ends of the garment 302 could also extend into the platen 702, rather than extending out of the platen structure 702. In this case, portions of the garment 302 can extend into a space between the platen pillar structure 206 and the sidewalls 208.

While various embodiments have been described above, it should be understood that they have been presented by way of example only and not limitation. Other embodiments falling within the scope of the invention may also become apparent to those skilled in the art. Thus, the breadth and scope of the invention should not be limited by any of the above-described exemplary embodiments but should be defined only in accordance with the following claims and their equivalents.

What is claimed is:

1. A device for holding fabric during a manufacturing process, comprising: a platen structure, comprising:

a platen base;

a plurality of platen sidewalls hinged to the platen base, each of the platen side walls having a foot structure; and and a platen top supported above the platen base;

a hoop structure having an open top, an open bottom and plurality of hoop sidewalls, the hoop structure being configured to fit around the platen top when lowered down over the platen structure, the each of the plurality of hoop sidewalls being configured to engage the foot of one of the platen sidewalls and wherein engagement of a hoop sidewall with the foot of a platen sidewall causes the platen sidewall to rotate upward.

2. The device as in claim 1, wherein the foot of each platen sidewall forms a flange oriented substantially 90 degrees relative to the rest of the platen sidewall.

3. The device as in claim 1, further comprising a hinge connecting each of the platen sidewalls with the platen base.

4. The device as in claim 1, wherein the platen top is supported above the platen base by a pedestal structure.

5. The device as in claim 1, wherein the platen top is supported above the platen base by a plurality of column structures.

6. The device as in claim 1, wherein the hoop structure further comprises an upper rim and at least one attachment bracket connected with the upper rim.

7. The device as in claim 1, wherein the platen structure is configured to fit within a garment printer.

8. The devices as in claim 1, wherein the platen structure and hoop structure are configured to fit within a garment printer with the hoop structure engaged on the platen structure.

9. The device as in claim 1, wherein the platen sidewalls are configured to extend outward from the platen top in a resting position and to rotate inward when engaged with the hoop sidewall.

10. The device as in claim 1, wherein each of the platen sidewalls is configured to hold a portion of a workpiece fabric against one of the plurality of hoop sidewalls when the foot of the platen sidewall is engaged by a bottom of the hoop sidewall.

11. The device as in claim 1, wherein the platen sidewalls are configured to have an increased coefficient of friction.

12. The device as in claim 1, wherein the platen sidewalls have a surface texture configured to increase friction.

13. The device as in claim 1, wherein the platen sidewalls have a surface coating comprising one or more of polymer, rubber, felt, or a hook and loop material.

* * * * *